United States Patent [19]

Lamb

[11] Patent Number: 4,991,369

[45] Date of Patent: Feb. 12, 1991

[54] WINDOW WITH REMOVABLE FIXED WINDOW SASH

[75] Inventor: Thomas L. Lamb, Lexington, N.C.

[73] Assignee: Binnings Building Products, Inc., Lexington, N.C.

[21] Appl. No.: 452,607

[22] Filed: Dec. 18, 1989

[51] Int. Cl.[5] ..... E06B 3/00; E06B 3/58

[52] U.S. Cl. ..... 52/476; 52/207; 52/656; 52/745; 49/463

[58] Field of Search ..... 52/207, 507, 459, 476; 16/193, 194; 49/404, 406, 407, 425, 463–466, 458, 482, 501

[56] References Cited

U.S. PATENT DOCUMENTS

| | | | |
|---|---|---|---|
| 321,603 | 7/1885 | Henry | 16/193 X |
| 651,994 | 6/1900 | Holland | 52/456 |
| 903,615 | 10/1908 | Stolp | 49/463 |
| 1,005,345 | 10/1911 | Soule | 49/425 X |
| 1,930,801 | 10/1933 | Guillaume | 49/404 |
| 1,950,949 | 3/1934 | Paulsen | 49/406 X |
| 2,237,609 | 4/1941 | Stevenson | 49/404 |
| 2,276,868 | 3/1942 | Polenz | 49/404 |
| 2,552,024 | 5/1951 | Angus et al. | 20/55 |
| 2,558,789 | 7/1951 | Sillman | 20/56.2 |
| 2,775,002 | 12/1956 | Fradera | 16/194 X |
| 2,909,813 | 10/1959 | Wilson | 49/464 X |
| 3,308,593 | 3/1967 | Smith | 52/456 |
| 3,449,862 | 6/1969 | Biro | 49/406 |
| 4,158,934 | 6/1979 | Olsen | 49/458 X |
| 4,554,770 | 11/1985 | Anders | 52/207 |
| 4,558,536 | 12/1985 | Dunsmoor | 49/404 |
| 4,693,043 | 9/1987 | Knapp | 52/211 |
| 4,783,938 | 11/1988 | Palmer | 52/456 X |

FOREIGN PATENT DOCUMENTS

| | | | |
|---|---|---|---|
| 599221 | 6/1960 | Canada | 52/207 |
| 2191809 | 12/1987 | United Kingdom | 49/466 |

*Primary Examiner*—Richard E. Chilcot, Jr.
*Assistant Examiner*—Deborah McGann Ripley
*Attorney, Agent, or Firm*—W. Thad Adams, III

[57] ABSTRACT

A window with a removable fixed window sash which comprises a window frame including opposed, spaced-apart top, bottom and side frame members. A window sash is positioned removably in the window frame. Top, bottom and side retainer members are mounted, respectively, on the top, bottom and side frame members. At least two of the top, bottom and side retainer members are removably positioned in the window frame in non-attached contact with the window sash to retain the window sash in the window frame means. At least one of the top, bottom and side members is attached to a respective top, bottom and frame member to retain the window sash in the window frame means. The attached member is removed when removal of the window sash is desired.

8 Claims, 6 Drawing Sheets

WINDOW WITH REMOVABLE FIXED WINDOW SASH

TECHNICAL FIELD AND BACKGROUND OF THE INVENTION

This invention relates to a window with a removable fixed window sash, or "lite." The particular window disclosed in this application includes a wood subframe with aluminum cladding, but this particular embodiment is not essential to the invention. The window sash is clad with wood on its inner exposed surfaces so that the window looks as if it is a conventional wood window.

Windows with a fixed window sash are known in the prior art. However, prior art windows have a window sash which is, for all practical purposes, permanently fixed into the window frame. If the glass in the sash is broken or if the sash needs to be removed for other reasons, the window must be disassembled by removing several permanently affixed panels or strips. Ordinarily, this must be done by skilled labor and is very labor intensive. The replacement sash must then be permanently installed back in the window frame. In some cases weatherstripping must be removed and replaced, further increasing the cost and complexity of the process. The window disclosed and claimed in this application preserves all of the aesthetic properties of fixed sash windows while greatly simplifying removal and replacement of the sash when required. The design also avoids the use of tilting or pivoting mechanisms which add to the weight and expense of the window, and detract from the appearance of the window. The sash may be removed and replaced with simple tools. Repeated removal and replacement of the sash does not require re-nailing of parts of the window frame which are visual apparent. The window therefore retains a new appearance much longer than other designs. The sash is removed without any need to remove any of the outside components of the window, thereby retaining the weathertightness of the window.

SUMMARY OF THE INVENTION

Therefore, it is an object of the invention to provide a window having a removable fixed window sash.

It is another object of the invention to provide a window which has a fixed window sash which can be easily removed for replacement or repair.

It is another object of the invention to provide a window having a removable fixed light which appears to be a conventional wooden window from the inside.

It is another object of the invention to provide a window having a removable fixed window sash wherein the means of removing and replacing the sash are not visually apparent.

These and other objects of the present invention are achieved in the preferred embodiments disclosed below by providing a window with a removable fixed window sash which comprises a window frame means including opposed, spaced-apart top, bottom and side frame members. A window sash is positioned removably in the window frame means. Top, bottom and side retainer members are mounted, respectively, on the top, bottom and side frame members. At least two of the top, bottom and side retainer members are removably positioned in the window frame means in non-attached contact with the window sash to retain the window sash in the window frame means. At least one of the top, bottom and side members is attached by attaching means to a respective top, bottom and frame member to retain the window sash in the window frame means. The attaching means are adapted to permit removal of the one of the top, bottom and side retainer members when removal of the window sash is desired.

Preferably, the window frame means comprises an aluminum clad wood subframe, and the top, bottom and side frame members comprise wood and are permanently attached to the metal cladding. The top, bottom and side retainer members comprise wood.

According to one preferred embodiment of the invention, the bottom and the side retainer members are removably positioned in the frame in non-attached contact with window sash, and the top retainer member is removably attached to the top frame member.

According to another preferred embodiment of the invention, the side retainer members include weatherstripping for engaging the window sash in weatherproofing relation.

According to yet another preferred embodiment of the invention, the window includes casing strips secured to the side frame members and engaging the side retainer members on a side remote from the window sash for urging the side retainer member into sealing relation with the window sash.

Preferably, the attaching means comprises nails.

According to one preferred embodiment of the invention, the window sash comprises two spaced-apart panes of glass defining an insulating void therebetween.

According to one preferred embodiment of the invention, the window with a removable fixed window sash comprises a window frame means defining a window sash-receiving opening therein. A window sash having a shape adapted for being positioned against the window frame means is removably retained in the opening in the window frame means. A first retainer means is removably attached by attaching means in the window frame means for retaining the window sash in the window frame means. A second retainer means is removably positioned in the window frame means in non-attached contact with the window sash. When removal of the window sash is desired, the first retainer means is removed by removing the attaching means and then the second retainer means is removed, thereby exposing the window sash for removal from the frame means.

Preferably, the window frame means includes a metal subframe clad with wooden facing members and the first and second retainer means comprise wood. Preferably, the attaching means comprise nails.

According to one preferred embodiment of the invention, the second retainer means is removably positioned in the window frame means in non-attached contact with the window sash by means of a rotating press fit.

According to another preferred embodiment of the invention, the frame means includes a top member, a bottom member and two opposed side members collectively defining a rectangular opening. The window sash is rectangular, the first retainer means comprises a top retainer removably attached to the top member, and the second retainer means comprises two side retainers removably positioned against the window sash and against respective the two opposed side members.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
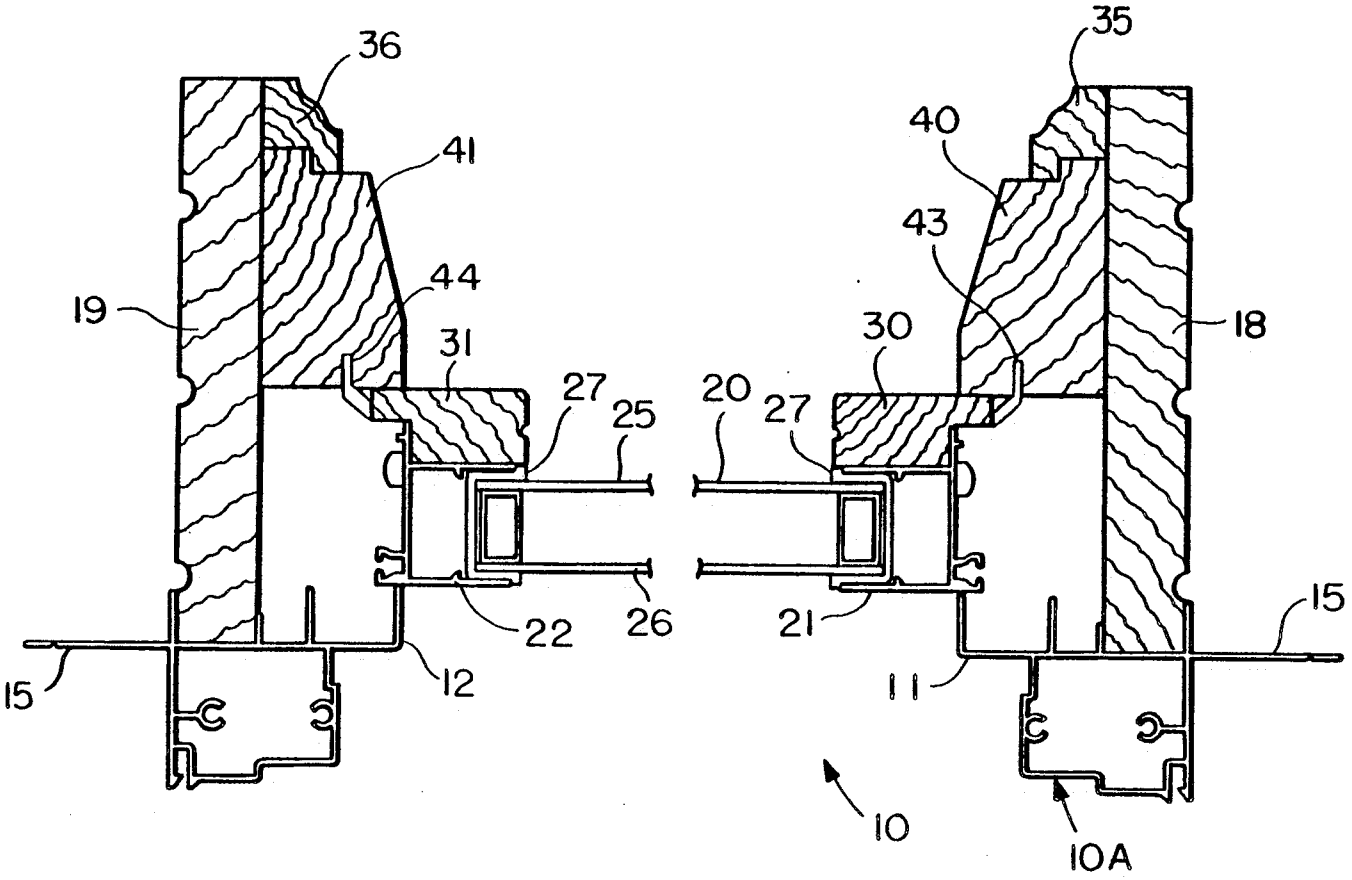
FIG. 1 is a horizontal cross-section of a window according to the embodiment of the invention disclosed in the application and illustrated in FIGS. 3–10.
Figure 2:
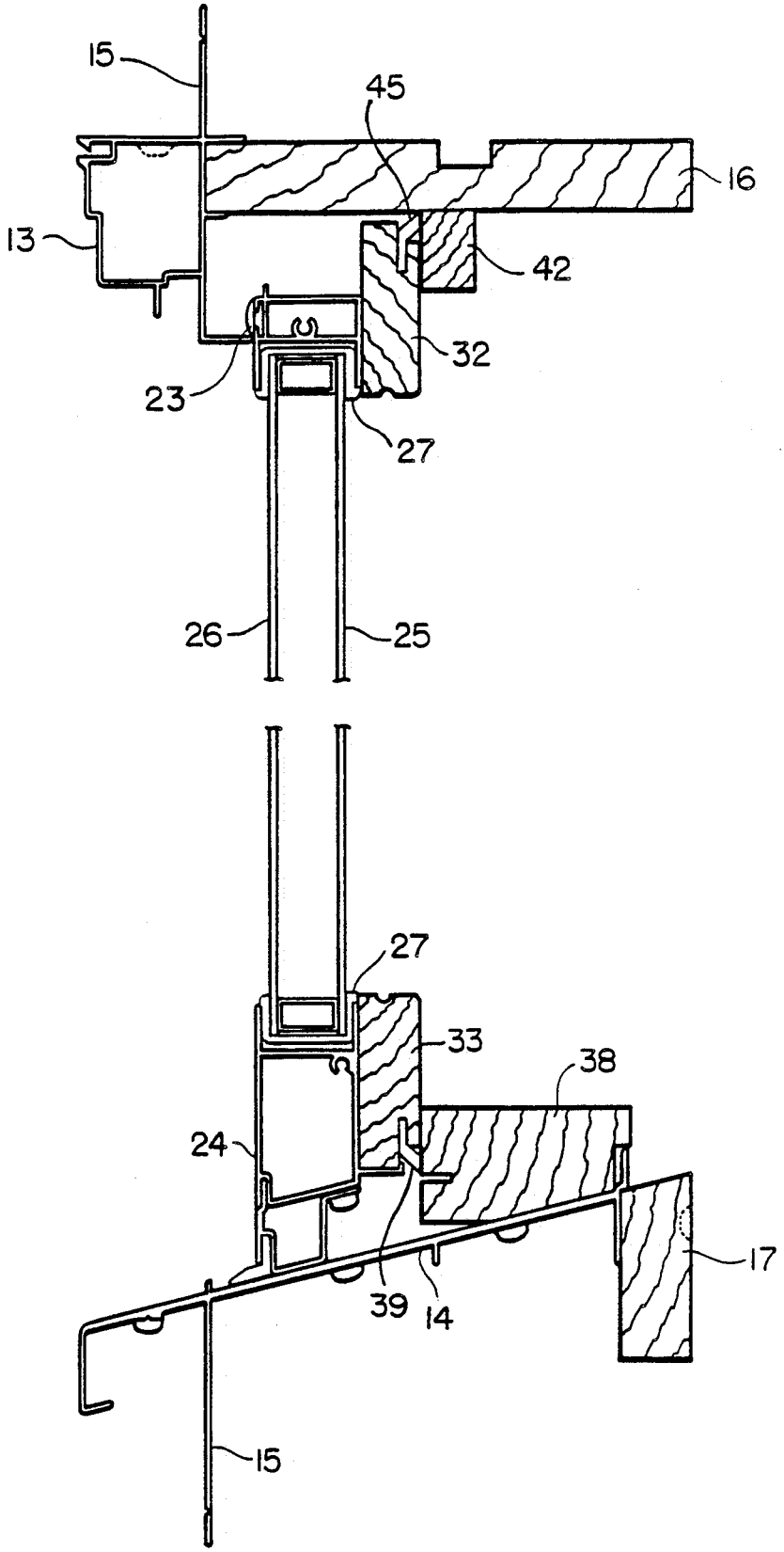
FIG. 2 is a vertical cross-section of the window illustrated in FIGS. 1 and 3–10.

Referring now specifically to the drawings, a window with a removable fixed window sash according to the present invention is illustrated in FIGS. 1 and 2, and shown generally at broad reference numeral 10.

As viewed in FIG. 1, the inside of the window 10, i.e., the side of the window on the inside of the building is at the top, with the outside of the window 10 at the bottom. As viewed in FIG. 2, the inside of the window 10 is to the right, with the outside at the left.

Window 10 includes a window frame 10A constructed of extruded aluminum side members 11 and 12 are connected to top and bottom frame members 13 and 14 and the assembled window frame 10A is integrated into a window opening in a building. A jamb brick mold 15 provide flanges which overlap the adjacent building structure.

A wooden header 16, a sill nailer 17, and wooden jambs 18, 19 are inserted into the side frame members 11, 12, respectively, and provide an inwardly projecting structure onto which other components are attached. A double glazed window sash 20 is inserted into the window frame 10A. Window sash 20 is constructed of window sash sides 21, 22, window sash top 23 and window sash bottom 24 into which double panes of glass 25, 26 are inserted and held by glazing vinyl 27.

Window sash 20 is faced with wooden inserts 30, 31, 32, 33 to give the appearance on the inside of the window 10 of a conventional wooden window. As is best shown in FIG. 2, side casing stops 35, 36 are attached to the inside of jambs 18, 19, respectively. A sill insert retainer 38 is removably affixed to the bottom frame member 14 by some suitable means, such as, for example, by a wedge fit. Weatherstripping 39 creates a weatherproof seal the sill insert retainer 38 and the wooden insert 33 and therefore the window sash 20.

Window sash 20 is removably fixed into the window frame 10A by means of two side retainer members 40, 41 and a top retainer member 42. These components permit the window sash 20 to be securely sealed into window frame 10A and yet be easily and quickly removed when desired. Weatherstripping 43, 44 and 45 creates a weatherproof seal between these components and the adjacent wooden inserts 30, 31 and 32, respectively.

The top retainer member 42 is held in place against the wood insert 32 by several small nails which are nailed vertically through the top retainer member 42 into the wooden header 16 along its length. The top retainer member 42 extends across the top edge of the two side retainer members 40, 41. The two side retainer members 40, 41 are also held in position frictionally by a rotating press fit against jambs 18, 19 and the wood inserts 30 and 31.

Figure 3:
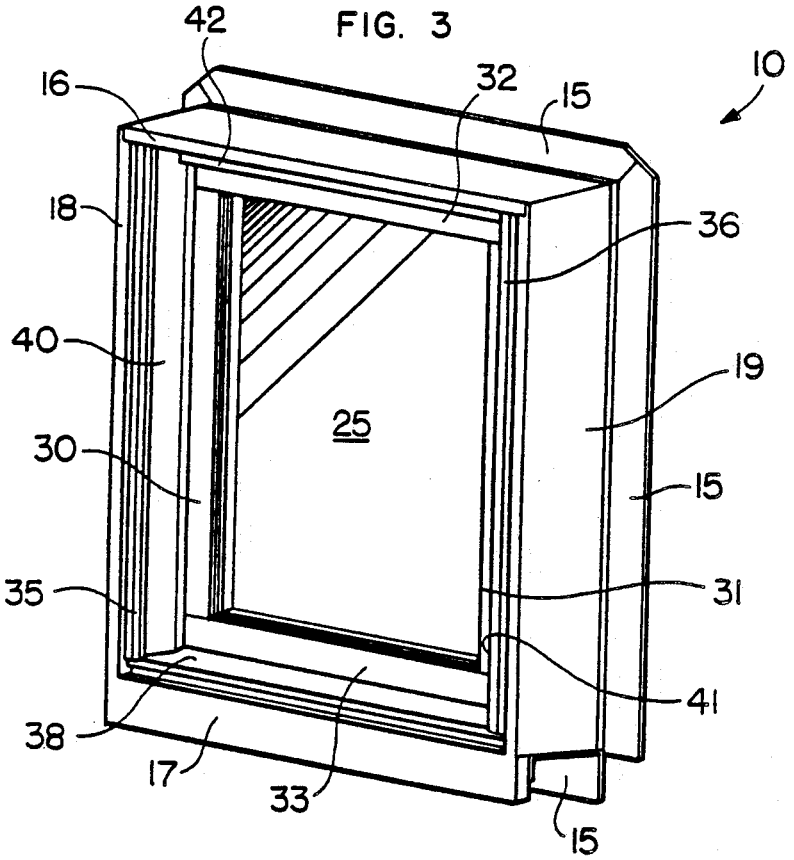
FIGS. 3–10 are sequential perspective views of the window illustrated in FIGS. 1 and 2 as the window sash is removed from the window frame.
Figure 4:
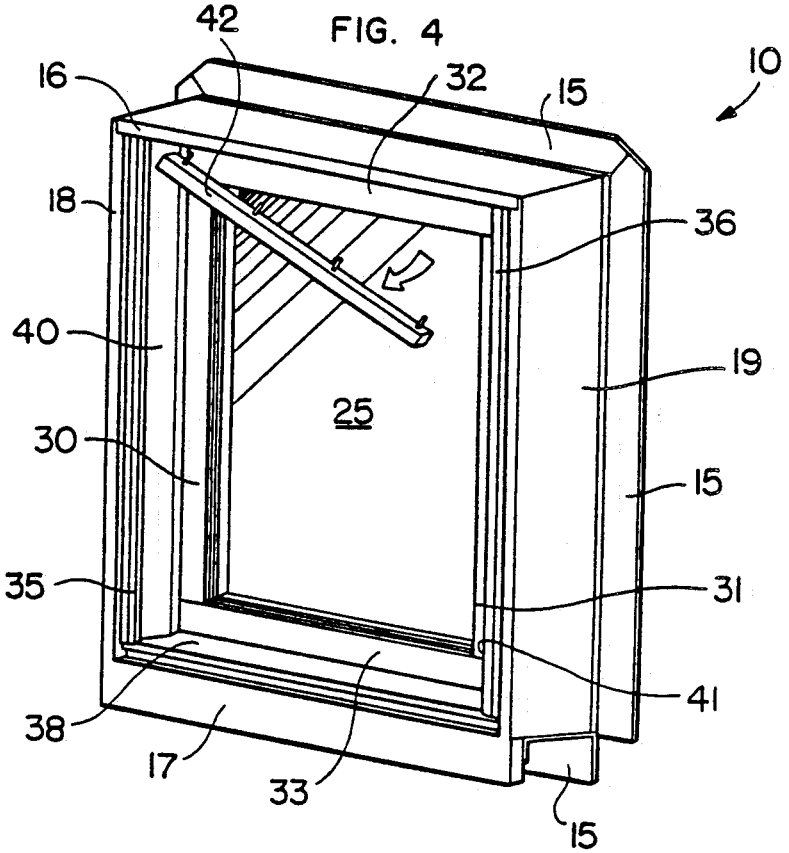
Figure 5:
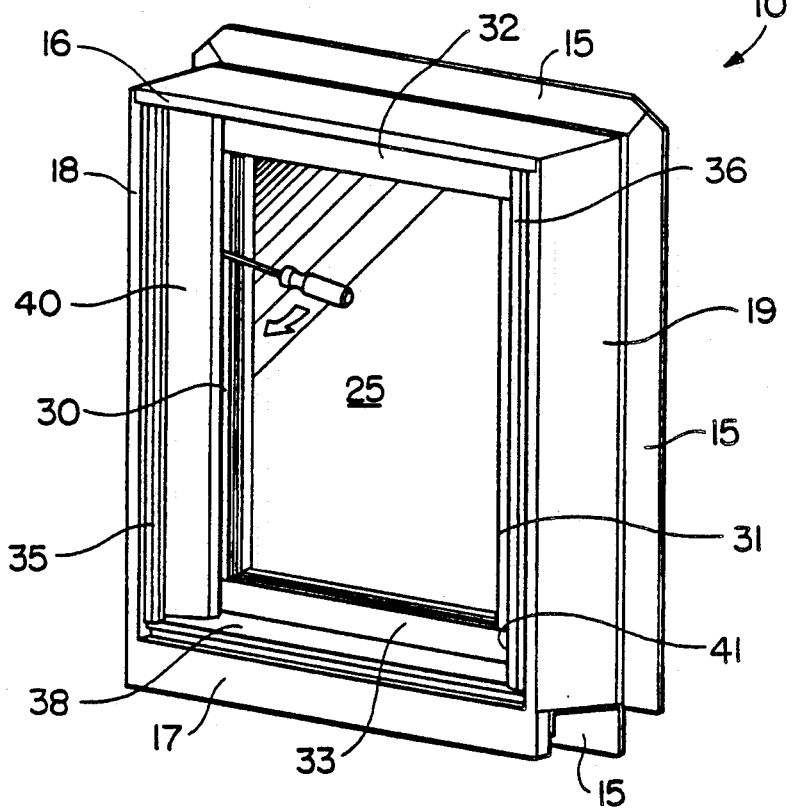
Figure 6:
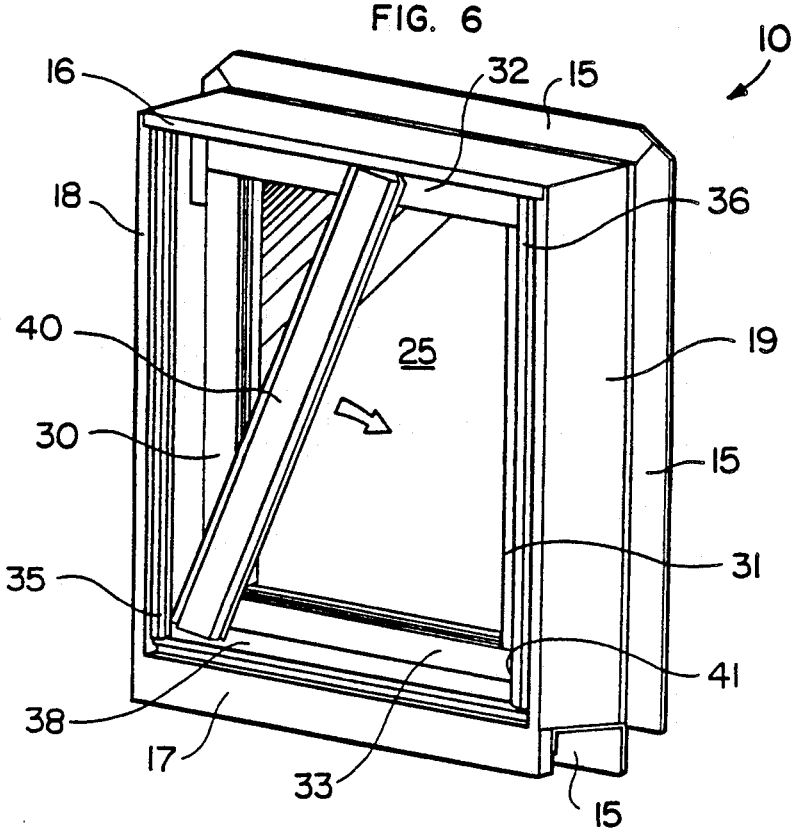
Figure 7:
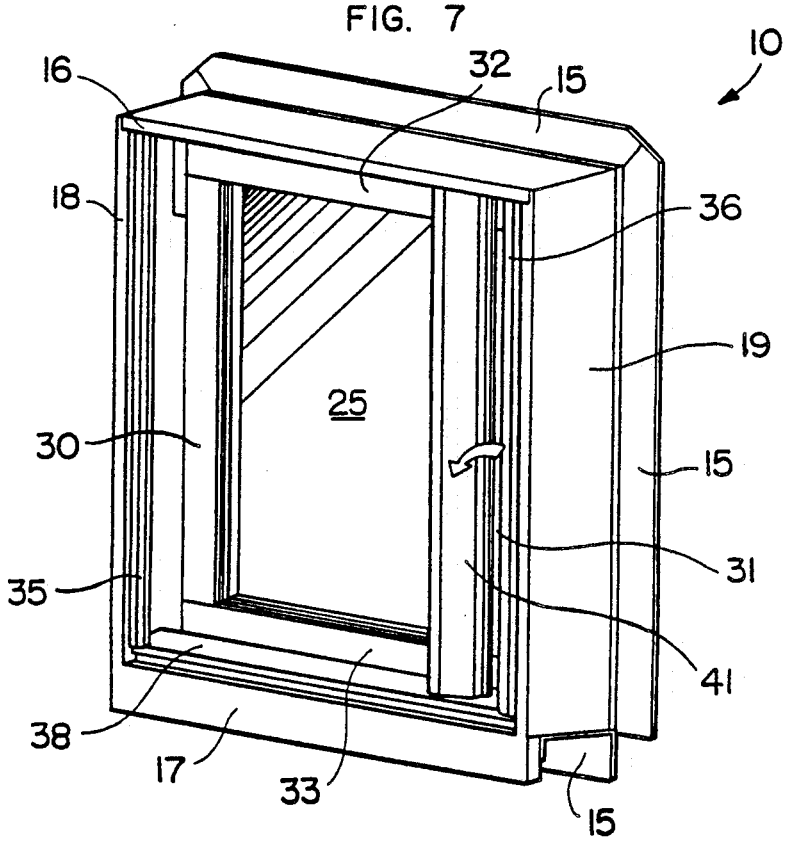
Figure 8:
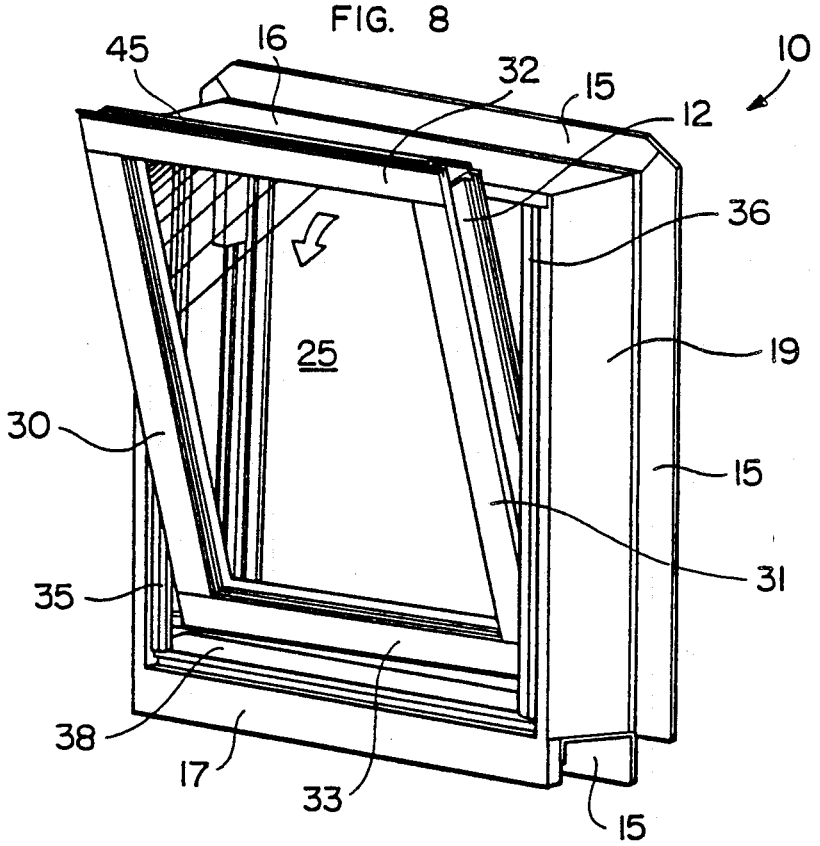
Figure 9:
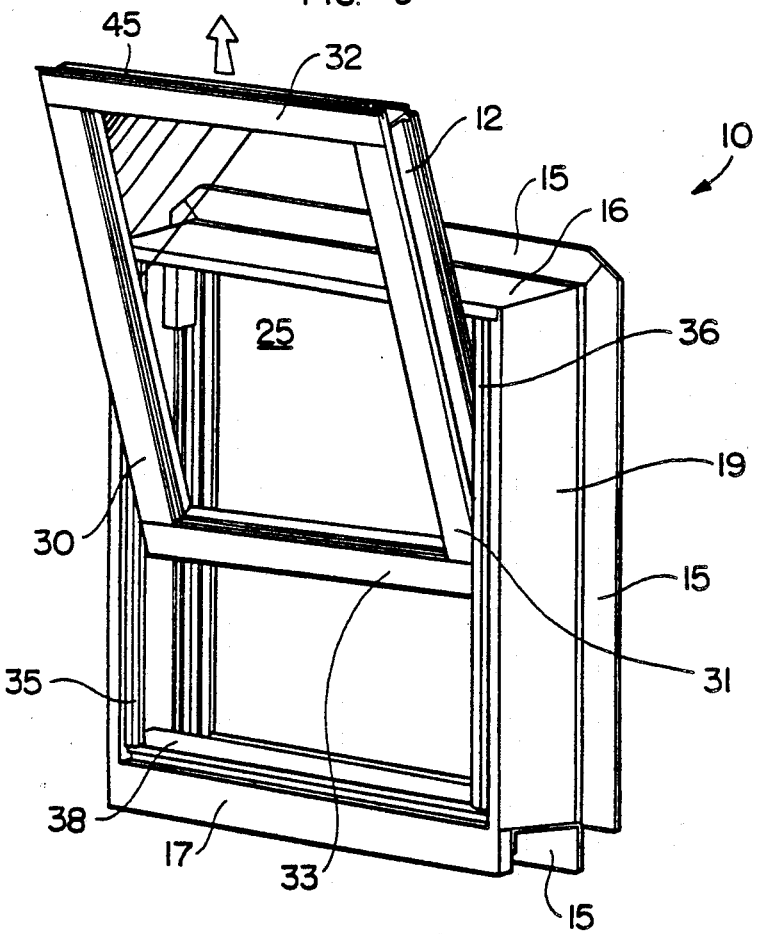

Referring now to FIGS. 3–10, removal of the window sash 20 from the window frame 10A is illustrated. The view of the window 10 in FIGS. 3–10 is from the inside, and FIG. 3 shows the assembled window 10 with the window sash 20 properly installed in the window frame 10A. Disassembly of the window begins by removing the top retainer member 42 as is shown in FIG. 4. The small nails in the relatively soft wood permits the top retainer member 42 to be easily pried away from the wooden header 16. Then, as is shown in FIG. 5, a knife or screwdriver is used to pry the side retainer member 40 away from the wood insert 30. The side retainer member 40 can be grasped with the hand and pulled out of the window frame 10A. Side retainer member 41 is removed in the same manner. See FIG. 7. With the top and side retainer members 42, 41, 40 removed, the window sash 20 is tilted inwardly, as is shown in FIG. 8. It is not necessary to remove the sill insert retainer 38.

Figure 10:
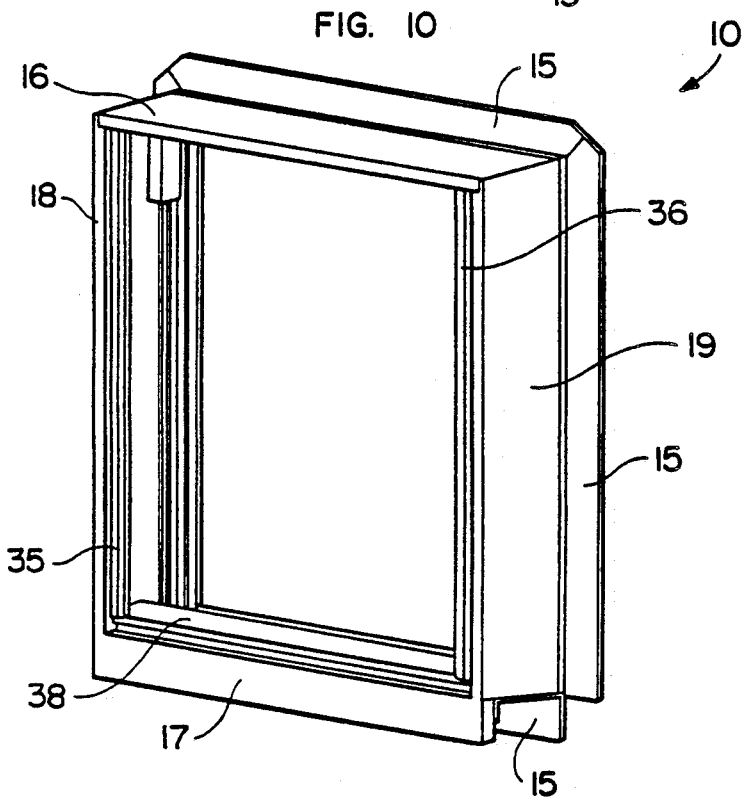

After tilting the window sash 20 inwardly, it is lifted up far enough to clear the sill insert retainer 38, and is then lifted out of the window frame 10A. See FIG. 9. The empty window frame 10A is shown in FIG. 10. The window sash 20 can then be repaired or replaced. The window sash 20 is re-installed by reversing the steps described above, insuring that the retainer members are pressed against the window sash 20 to compress the weatherstripping before finally nailing the top retainer member 42 back into place in the jamb 16.

While the arrangement described above is the presently preferred and best mode of practicing the invention, the nailed retainer member need not necessarily be at the top of the window. Staples, small screws or other removable attaching means may be used instead of nails. Other shapes of windows will require a different arrangement and number of retaining members.

A window with a removable fixed window sash is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A window with a removable fixed window sash, comprising:

(a) window frame means including opposed, spaced-apart top, bottom and side frame members;

(b) a window sash having a top and bottom and first and second opposing sides, said window sash positioned removably in said window frame means;

(c) window sash retaining means for sequentially holding the bottom, sides and top of the window sash in sealing relation in the window frame means, wherein the top retainer member, when installed, spans the distance in between the first and second side retainer member, and comprising, in sequence of installation:

(i) a bottom retainer member for holding the bottom of the window sash against the bottom frame member of the window frame means;

(ii) a first side retainer member for engaging one end of the bottom retainer member and holding the first side of the window sash against a corresponding side of the window frame means;

(iii) a second side retainer member for engaging the other end of the bottom retainer member and holding the second side of the window sash against a corresponding side of the window frame means;

(iv) a top retainer member for engaging and holding the top of the first and second side retainer members against the first and second sides of the window frame means and for engaging the top of the window sash and holding the top of the window sash against the top member of the window frame means;

and whereby the window sash can be removed for repair or replacement by reversing the sequence set out in (c)(i)–(iv).

2. A window according to claim 1, wherein said window frame means comprises an extruded metal subframe, and said top, bottom and side frame members comprise wood and are permanently attached to said metal subframe.

3. A window according to claim 2, wherein said top, bottom and side retainer members comprise wood.

4. A window according to claim 2, wherein said bottom retainer member is removably attached to said metal subframe, said side retainer members are removably positioned in said frame in nonattached contact with window sash, and said top retainer member is removably attached to said top frame member.

5. A window according to claim 4, wherein said side retainer members include weatherstripping for engaging said window sash in weatherproofing relation.

6. A window according to claim 5, wherein said window includes casing strips secured to said side frame members and engaging said side retainer members on a side remote from said window sash for urging said side retainer member into sealing relation with said window sash.

7. A window according to claim 3, wherein said attaching means comprises nails.

8. A window according to claim 1, wherein said window sash includes at least one pane of glass.

* * * * *